United States Patent [19]

Swanson

[11] Patent Number: 4,610,419

[45] Date of Patent: Sep. 9, 1986

[54] PICTURE HANGER

[76] Inventor: Arthur P. Swanson, 1454 Estate La., Glenview, Ill. 60025

[21] Appl. No.: 774,582

[22] Filed: Sep. 10, 1985

[51] Int. Cl.[4] ..... F16M 13/00; A47G 1/16

[52] U.S. Cl. ..... 248/547; 248/493

[58] Field of Search ..... 248/547, 489, 493, 497, 248/498, 301, 496, 470

[56] References Cited

U.S. PATENT DOCUMENTS

| | | | |
|---|---|---|---|
| 102,945 | 5/1870 | Judd | 248/547 |
| 267,459 | 11/1982 | Riley . | |
| 1,409,291 | 3/1922 | Giroux | 248/493 |
| 2,102,488 | 12/1937 | Sirera | 105/354 |
| 2,126,630 | 8/1938 | Gleitsman | 248/547 |
| 2,226,168 | 12/1940 | Kass | 248/547 |
| 2,330,373 | 9/1943 | Moore | 248/489 |
| 2,334,700 | 11/1943 | Frey | 248/493 |
| 2,454,813 | 11/1948 | Larson | 248/547 X |
| 2,877,972 | 3/1959 | Sutton et al. | 248/493 X |
| 2,887,801 | 5/1959 | Walters | 40/128 |
| 3,226,065 | 12/1965 | Smith | 248/547 X |
| 3,235,218 | 2/1966 | Graham | 248/225 |
| 3,982,719 | 9/1976 | Kilborne | 248/489 |
| 4,455,756 | 6/1984 | Greene | 248/547 X |

FOREIGN PATENT DOCUMENTS

| | | | |
|---|---|---|---|
| 51315 | 7/1919 | Sweden | 248/489 |

*Primary Examiner*—J. Franklin Foss

*Attorney, Agent, or Firm*—Hill, Van Santen, Steadman & Simpson

[57] ABSTRACT

A picture hanger is provided with a hook that will wedge-lock a conventional picture hanging cord against movement to maintain the picture in its desired level position. The hook has an open top, open ends, and sidewalls defining an acute angle therebetween converging to a closed bottom that is narrower than the picture hanging cord so that the cord will be pulled by the weight of the picture into wedge-locked relation with the hook and cannot slide or tilt until the weight is lifted.

11 Claims, 6 Drawing Figures

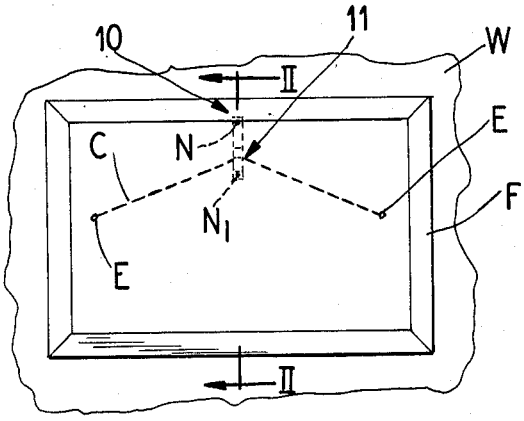
FIG. 1
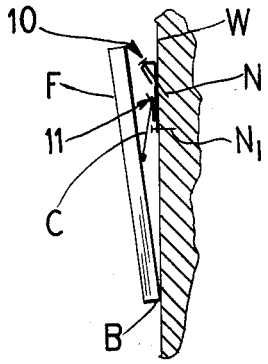
FIG. 2
FIG. 3
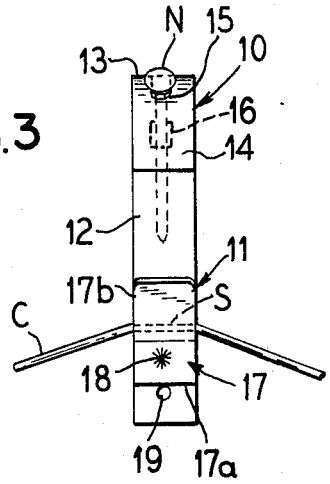
FIG. 4
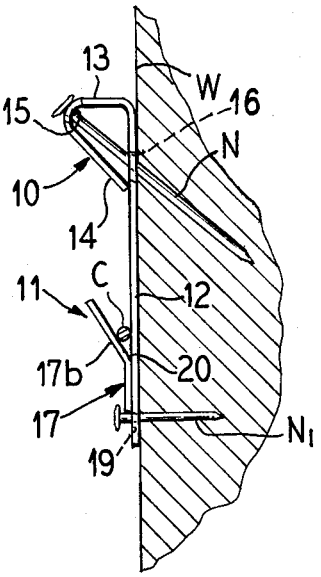
FIG. 5
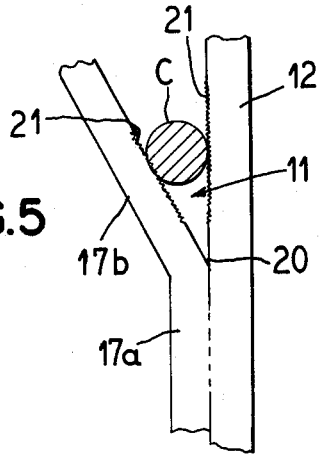
FIG. 6
(PRIOR ART)
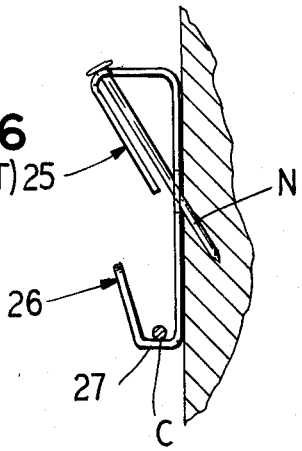

PICTURE HANGER

FIELD OF THE INVENTION

This invention relates to the art of hanging pictures and the like and particularly deals with a hanger having a hook that will wedge-lock a picture cord under the weight of the suspended picture to maintain the selected level for the picture.

BACKGROUND OF THE INVENTION

Pictures hung on a wall from conventional hangers are easily displaced from their desired level position by external forces such as an inadvertent touch or wall vibrations. It is thus frequently necessary to straighten the picture back to its desired level position. The displacement is accommodated and actually facilitated by relative movement of the picture hanging cord in the hook of the hanger since the conventional hook has a bottom or bight portion freely receiving the cord thus permitting it to slide and tilt. Further, many commonly used picture hangers are attached to the wall by a single nail which permits them to swing relative of the wall thus further facilitating tilting of the picture.

It would therefore be an improvement in this art to provide picture hangers with cord receiving hooks that develop sufficient friction under the weight of the suspended picture to wedge-lock the cord against movement relative to the hook. It would be a further improvement to provide picture hangers which cannot swing, which wedge-lock the picture cord in fixed position under the weight of the picture, and accommodate removal of the cord from the hook when the picture is lifted.

SUMMARY OF THE INVENTION

According to this invention a picture hanger is provided with an open top, open-sided, closed bottom wide hook having converging sidewalls gripping the picture cord before it reaches the bottom and thereby developing sufficient friction forces which will prevent sliding or tilting of the cord. The sidewalls have an appreciable width to engage a linear span of the cord.

The picture hanger may be nailed to a wall in the conventional manner but also, preferably, accommodates a second nail that will prevent swinging of the hanger on the wall. The hook is preferably defined by a flat strip back of the hanger and a leg strip spot-welded to this back and diverging therefrom at an acute angle to provide the open top, open-ended hook. The angle of divergence is preferably less than 30° and the bottom of the hook is always narrower than the picture cord so that the cord will be gripped by the converging sidewalls.

Since area of contact between the picture cord and the hook is not involved in developing the static friction between the picture cord and the hook, the width of the hook can be the same as in conventional strip type hangers and may very widely depend upon the weight to be supported by the hanger.

The hanger is preferably made from a strip or ribbon of metal, such as brass or steel, but any suitable construction material including, plastics materials, may be used. The strip may vary in width, thickness and size to suit different weights of pictures. Widths of from $\frac{1}{8}$ to $\frac{1}{2}$ inch are useful to grip a span of the cord. The inside faces of the hook may be roughened or knurled to increase the coefficient of friction between the picture cord and the walls of the hook engaging the cord.

It is then an object of this invention to provide a picture hanger with a hook that develops sufficient static friction to lock a picture hanging cord in fixed relation therewith.

Another object of the invention is to provide a picture hanger with a wedge-locking hook.

A further object of the invention is to provide a picture hanger with a picture cord receiving hook that has sidewalls converging at an acute angle to frictionally grip the cord before it reaches the bottom of the hook.

Other and further objects of this invention will be apparent to those skilled in this art from the following detailed description of the annexed sheet of drawings which illustrate a best mode embodiment of the invention.

ON THE DRAWINGS

FIG. 1 is front view of a picture hung on a wall and showing in dotted lines the manner in which it is suspended from a hanger of this invention;

FIG. 2 is a cross-sectional view along the line II—II of FIG. 1;

FIG. 3 is a front elevational view of the hanger of FIGS. 1 and 2 illustrating the portion of the picture cord extending through the hook portion.

FIG. 4 is a side elevational view of the hanger and cord of FIG. 3 including a vertical section of the wall to which the hanger is nailed.

FIG. 5 is a diagrammatic fragmentary side elevational view of the hook portion of the hanger illustrating the wedging of the cord in the hook.

FIG. 6 is a side elevational view of a prior art picture hanger nailed to a wall and suspending a picture cord.

AS SHOWN ON THE DRAWINGS

As shown in FIGS. 1 and 2, the picture hook 10 of this invention is secured to a wall W by a nail N and has a hook portion 11 suspending a cord C secured at its ends E to the back of a picture frame F. The picture frame F is tilted away from the wall W, as is conventional, and the bottom of the frame is biased toward the wall W as illustrated at B. The weight of the picture and frame pulls the cord C into the bottom of the hook 11 where it will have a horizontal span S parallel with the bottom of the hook and inclined side portions as illustrated in FIG. 3. The gripped span of the cord locks the cord against tilting and sliding.

The hanger 10 is formed from a flat strip or ribbon of metal, such as brass or steel, with an upright planar back portion 12, a forwardly projecting top wall 13, and an inclined skirt 14 extending from the outer end of the top wall 13 toward the back 12. A nail hole 15 is formed through the bight portion between the wall 13 and skirt 14. A second nail hole 16 is formed through the back 12 just above the bottom end of the skirt 14. Thus, the nail N inserted through these holes 15 and 16 will be presented to the wall W at a downwardly inclined angle, to better carry the load. The shank of the nail N is substantially parallel with the skirt 14.

The lower portion of the back 12 has a second strip 17 spot-welded thereto at 18. This strip has the same width as the back 12 and has a flat bottom portion **17*a* confronting and mating with the back portion together with an inclined upper portion 17*b* diverging from the back 12** at an angle of about 30° or less.

A nail hole 19 is provided through the back 12 below the strip 17 to receive a second nail $N_1$ which when driven into the wall W will prevent the hanger from swinging on the nail N.

The hook 11 is thus defined by a flat wide portion of the planar back 12 and the inclined wide planar portion 17*b* of the overlying strip 17. The hook 11 thus has an open top, open ends, and wide planar sidewalls which converge to a closed bottom edge 20. The cord C, as best illustrated in FIG. 5, will thus be bottomed on the sidewalls 12 and 17*b* before it can reach the bottom edge 20. The diverging angle of the sidewall 17*b* relative to the back 12 can be varied from a maximum of say 30° for the large diameter cord used to hang heavy pictures to a lesser angle of say 10° to receive smaller diameter cords suspending lighter weight pictures. The faces of the hook 11 confronting the cord C, as illustrated in FIG. 5, can be roughened or knurled, as indicated at 21, to increase the coefficient of friction between the cord and the sidewalls of the hook.

It should be understood that as the weight of the picture pulls the cord C downwardly into the hook 11, the sidewalls defining the hook will squeeze the cord into locked engagement therewith. A wedge fit is thus obtained under the weight of the picture and the cord cannot tilt or slide in the hook.

In contrast, as illustrated in FIG. 6, a conventional picture hanger 25 has a U-shaped bottom hook 26 with a wide bight or bottom portion 27 on which the cord C rests. The cord is thus free to slide and tilt in this hook 26.

While, as shown, it is desirable to weld a second strip 17 on the back 12 of the hanger of this invention to insure the sharp line bottom edge 20 for the hook 11, other methods of forming a sharp V-shaped hook could be employed. However, the bending of an extension on the back 12 over the front face of the back could result in a rounded bight portion for the bottom of the hook which might permit the cord to rest thereon thereby preventing the creation of the wedge-lock. The welded-on strip insures against this possibility.

It will further be understood that the wedging hook of this invention will not provide a bottom on which the picture cord C could rest even though the cord is compressible, such as string or rope material, or is a very thin wire. The angle of the wedge can thus be varied from a minimum of about 5° to 10° to a maximum of about 25° to 30° depending upon the diameter and compressible nature of the picture cord material.

From the above descriptions it will be understood that this invention now provides a picture hanger with a cord receiving hook that will lock the cord against sliding or tilting when suspending the weight of the picture, but can be released from the hook when the picture cord is raised so as to accommodate lifting of the picture off of the hanger. The term "cord" is used herein in its generic sense to include any strand material for hanging pictures and other objects on a wall or the like and such as string, rope, wire, cable, etc.

I claim as my invention:

1. A picture hanger comprising a rigid strip having an upright back, an outturned top leg, a downwardly and inwardly inclined skirt depending from the outer end of the top leg, a first nail hole through the outer end of the leg, a second nail hole through the back adjacent the skirt to receive a nail extending through the first hole, a third nail hole in the lower portion of the back, and an open top, open end continuous planar sidewall wedge hook on the back above the third nail hole, with the planar sidewalls spanning the entire distance between the open ends, whereby a first nail extending through the first and second nail holes is inclined to be driven into a wall at an angle, a second nail extending through the third hole is driven into the wall below the first nail to prevent swinging of the hook on the wall, and said wedge hook friction locks a picture cord therein under the weight of a suspended picture.

2. The hanger of claim 1 wherein the sidewalls of the hook define an acute angle of from 5 to 30 degrees.

3. The hanger of claim 1 wherein the angle is not more than about 30°.

4. The hanger of claim 1 wherein the opposed faces of the sidewalls are roughened.

5. The hanger of claim 1 wherein the sidewalls of the hook are formed by the upright back of said rigid strip and a separate strip welded to said back and said strips having widths of about $\frac{1}{8}$ to $\frac{1}{2}$ inch.

6. A picture hanger comprising a rigid strip having an upright back portion with a flat planar front face, a nail hole through said back at the upper end thereof for securing said strip to a wall, a second rigid planar strip portion having an upright bottom leg overlying said flat front face of said back with an outturned top leg diverging from said front face at an acute angle, said outturned leg having a flat planar inner face confronting the front face of the back to define therewith an open top open ended hook with planar sidewalls extending continuously between the open ends and converging to a closed bottom edge which is too narrow to bottom a picture cord whereby the cord will be wedge-locked against sliding without being kinked when pulled downwardly into the hook by the weight of a picture and will be released to the open top of the hook when lifted for permitting sliding to adjust the level of the picture.

7. A picture hanger comprising a rigid metal strip having an upright back with a flat planar front face, an outturned top leg, a downwardly and inwardly inclined skirt depending from the outer end of the top leg, a first nail hole through the outer end of the leg, a second nail hole through the back adjacent the skirt to receive a nail extending through the first hole for securing the hanger to a wall in upright position, a second flat planar strip having an upright bottom leg welded to the bottom portion of said front face and an integral outturned top leg diverging from said front face and having a back face cooperating with the front face of the back to define therewith the flat planar sidewalls of an open top open end hook converging to a closed bottom edge which is too narrow to bottom a picture cord whereby said hook frictionally locks a picture cord between the sidewalls under the weight of a suspended picture and frees the cord to the open top of the hook when the weight of the picture is released.

8. The picture hanger of claim 6 wherein the acute angle is not more than about 30°.

9. The picture hook of claim 6 wherein the planar front face of the upright back and the confronting inner face of the outturned leg have a width of about $\frac{1}{8}$ to $\frac{1}{2}$ inch.

10. The picture hanger of claim 6 wherein the bottom leg of the second rigid planar strip portion is welded to the front face of the upright back adjacent the closed bottom edge of the hook.

11. The picture hanger of claim 6 wherein the inner face of the outturned top leg and the front face of the back opposite said inner face are roughened.

* * * * *